US009640928B2

(12) United States Patent
Holzapfel

(10) Patent No.: US 9,640,928 B2
(45) Date of Patent: May 2, 2017

(54) SLIP RING BRUSH HAVING A GALVANIC MULTI-LAYER SYSTEM

(71) Applicant: Schleifring und Apparatebau GmbH, Fürstenfeldbruck (DE)

(72) Inventor: Christian Holzapfel, Fürstenfeldbruck (DE)

(73) Assignee: SCHLEIFRING UND APPARATEBAU GMBH, Furstenfeldbruck (DE)

( * ) Notice: Subject to any disclaimer, the term of this patent is extended or adjusted under 35 U.S.C. 154(b) by 437 days.

(21) Appl. No.: 14/152,496

(22) Filed: Jan. 10, 2014

(65) Prior Publication Data

US 2014/0179125 A1 Jun. 26, 2014

Related U.S. Application Data

(63) Continuation of application No. PCT/EP2012/060918, filed on Jun. 8, 2012.

(30) Foreign Application Priority Data

Jul. 13, 2011 (DE) ..... 10 2011 051 804

(51) Int. Cl.
*H01R 39/10* (2006.01)
*H01R 39/02* (2006.01)
(Continued)

(52) U.S. Cl.
CPC ..... *H01R 39/10* (2013.01); *H01R 39/025* (2013.01); *H01R 39/08* (2013.01); *H01R 39/24* (2013.01)

(58) Field of Classification Search
USPC ..... 310/219–253
See application file for complete search history.

(56) References Cited

U.S. PATENT DOCUMENTS 2,551,030 A * 5/1951 Madden ..... 310/232
3,226,666 A * 12/1965 Lord ..... 439/23
(Continued)

FOREIGN PATENT DOCUMENTS

CN 86108108 12/1987
CN 1578069 2/2005
(Continued)

OTHER PUBLICATIONS

Written Opinion in International Application No. PCT/EP2012/060918 mailed Jan. 13, 2014.
(Continued)

*Primary Examiner* — Naishadh Desai
(74) *Attorney, Agent, or Firm* — Norton Rose Fulbright US LLP

(57) ABSTRACT

A slip ring arrangement comprises a brush with a first contact material on the surface, which rests on a slideway with a second contact material on the surface. The slideway further comprises a layer with a third contact material beneath the second contact material. In this case, the abrasion of the brush is lower than that of the second contact material in the case of a sliding contact between the brush and the second contact material. In the case of a sliding contact between the brush and third contact material, the abrasion of the brush is higher than that of third contact material. As a result, the second contact material of the slideway is degraded first, which corresponds to the normal service life of a slideway. Subsequently, the brush is worn off relative to the third contact material, by means of which a further considerable extension in the service life is achieved.

12 Claims, 3 Drawing Sheets

(51) Int. Cl.
*H01R 39/08* (2006.01)
*H01R 39/24* (2006.01)

(56) References Cited

U.S. PATENT DOCUMENTS

| | | | | |
|---|---|---|---|---|
| 3,821,024 | A * | 6/1974 | Wilkin et al. | 428/634 |
| 4,306,169 | A * | 12/1981 | Diepers | 310/248 |
| 4,398,113 | A * | 8/1983 | Lewis et al. | 310/232 |
| 6,517,357 | B1 * | 2/2003 | Athanasiou et al. | 439/26 |
| 6,927,521 | B2 | 8/2005 | Okubo et al. | 310/233 |
| 2007/0032099 | A1 * | 2/2007 | Schilling | 439/13 |

FOREIGN PATENT DOCUMENTS

| | | | |
|---|---|---|---|
| DE | 14 89 080 | A | 1/1969 |
| DE | 101 246 | | 10/1973 |
| DE | 34 34 627 | A1 | 6/1985 |
| EP | 0 662 736 | A | 7/1995 |

OTHER PUBLICATIONS

International Preliminary Report on Patentability in International Application No. PCT/EP2012/060918 mailed Jan. 14, 2014.

* cited by examiner

SLIP RING BRUSH HAVING A GALVANIC MULTI-LAYER SYSTEM

PRIORITY CLAIM

This application is a continuation of pending International Application No. PCT/EP2012/060918 filed on 8 Jun. 2012, which designates the United States and claims priority from German Application No. 10 2011 051 804.5 filed on Jul. 13, 2011, both of which are incorporated by reference in their entireties.

BACKGROUND OF THE INVENTION

1. Field of the Invention

The invention relates to a slip ring assembly for transmitting electrical signals by means of sliding contacts between mutually rotatable parts. At least one sliding contact, which is also known as a brush and is made of an electrically conductive material, will slide on a slideway which is also made of an electrically conductive material. As a result of the galvanic contact between the slideways and the contact it is possible to transfer electric current.

2. Description of Relevant Art

EP 0 662 736 A discloses a slip ring assembly in which a brush runs with several wires in a V-groove. This leads to a low contact resistance by connecting several contacts in parallel.

A slip ring assembly is disclosed in DE 14 89 080 A in which the brushes in form of massive individual wires run in grooves of a slideway.

U.S. Pat. No. 4,398,113 discloses a further brush with several wires. In this case, the slideway has a lower hardness than the brush, so that soft gold from the slideway will adhere to the brush during initial running of the brush. This leads to a durable and low-friction coating on the brush.

DE 34 34 627 A1 discloses a slip ring assembly in which a hard amorphous intermediate layer is arranged under a conductive contact layer. This amorphous intermediate layer supports the contact layer and ensures that it is provided with a long useful life in combination with low abrasion.

In order to achieve good transmission properties, the pairings of contacts, i.e. the outer metal layers of the brushes and the slideways, are made of electrically well-conducting and abrasion-proof materials. Layers based on gold are preferably used. Wear of brushes and/or slideways still occurs frequently after longer periods of operation. If the gold layer of a slideway is damaged, the brush runs on the layer situated beneath said slideway, which comprises nickel or another similar metal. Massive contact disturbances immediately occur here, leading to strong abrasion of the brush. In such defects, it is frequently only possible to completely exchange the brush and the slideway.

SUMMARY OF THE INVENTION

The embodiments are based on the object of extending the service life of slip ring systems, providing slip ring systems with emergency running properties and enabling the early indication of wear and tear.

In an embodiment, a combination of different contact materials with different abrasion properties is used. The brush, which can comprise one or several wires, has a first electrically well-conducting contact material on its surface, i.e. on the surface of the one or several wires. The brush can also completely consist of said first contact material. The brush lies on a respective slideway and can slide along the same during movement on said slideway.

The slideway comprises at least one upper layer with a second electrically well-conducting contact material. A bottom layer with a third electrically well-conducting contact material is arranged under said upper layer. The layers of the second and third contact material have similarly good properties in contact with the first contact material and have a low contact resistance. Further layers such as layers based on nickel and/or copper for example can be disposed beneath this layer. These layers are preferably applied by electroplating.

In a preferred embodiment, these layers have specific properties with respect to each other in sliding contact. As a result, during the contact of the brush comprising a first contact material with the upper layer comprising the second material, the abrasion of the second contact material is higher than that of the first contact material. As a result, the upper layer of the slideway comprising the second contact material will wear off more rapidly than the brush comprising the first contact material. Furthermore, during the contact of the brush comprising the first contact material with the bottom layer comprising the third contact material, the abrasion of the third contact material is lower than that of the first contact material.

On the basis of this configuration, the abrasion occurs as follows on the basis of a new brush with a new slideway: the second contact material of the upper layer will wear off first, which corresponds to the normal service life of a slip ring system. Once the layer of the second contact material has been consumed, the brush makes contact with the third contact material of the bottom layer. The transmission properties of the slip ring will be maintained in this case because the third contact material is also provided with good electric conductivity and good contact properties. As a result, emergency running properties and a considerable extension in the service life can be achieved. Said third contact material of the slideway offers higher wearing resistance than the first contact material of the brush, as already explained above. As a result, the brush will wear off more rapidly than the slideway. During the maintenance of the slip ring assembly, wear and tear of the brush can be recognized in a relatively simple way through its uneven surface. In this case which concerns a worn brush, it is also necessary to exchange the slideway. Since in this case the gold layer on the slideway has not been removed completely, the slideway or a module which carries several slideways can now easily be repaired by electroplating. This is not possible in the modules corresponding to the state of the art, in which the gold layer has been abraded up to the bottom layer.

The abrasion properties of the contact materials are relevant for the embodiments shown herein. Adhesive wear and tear (cold welding) occurs especially in slip ring systems. Cold welding frequently occurs on the harder material and the soft material is subjected to a loss of material. The hardness is a characteristic value which allows a first statement on the behavior. Depending on the used material system, behavior can occur in which cold welding is also formed on the soft material, especially in the case of low differences in hardness. A component test is therefore performed in new unknown pairings of materials in which the wearing behavior can be recognized securely.

The upper layer of the slideway with the second contact material has a hardness in an especially preferred manner which is lower than that of the two other contact materials. The brush with the first contact material preferably has a higher hardness than the upper layer of the slideway with the second contact material and a lower hardness than the bottom layer of the slideway third contact material. Furthermore, the bottom layer of the slideway with the third contact material preferably has a hardness which is higher than the other two contact materials. The harder bottom layer leads to a stable layer assembly. The term hardness shall be understood in this case as the hardness according to Rockwell or Brinell or Vickers.

It is further preferably preferred if the bottom layer the slideway has a relatively smooth surface, especially a roughness height of less than 1 μm and especially preferably less than 0.1 μm. As a result, sliding of the brush with especially low abrasion on the layer can be realized.

It is especially advantageous if the brush is massively made of the first contact material. This provides an especially large amount of material for abrasion, thus resulting in an extended service life.

In a further embodiment, the brush comprises a further layer with a fourth contact material beneath the layer with the first contact material. The fourth contact material is preferably harder than the first contact material and more preferably harder than the third contact material. The service life of the slip ring can further be extended in this way.

The first contact material of the brush has a hardness in the range of HV 270-350 by way of example. Furthermore, the hardness of the second contact material of the slip ring can lie in a range of HV 180-220 by way of example. Finally, the range of the hardness of the third contact material of the slip ring can lie in a range of HV 350-420.

The term contact material always relates to materials which in contact with a further contact material are suitable for transmitting electrical signals. Contact materials preferably have low contact resistances and low contact noise during mechanical movement for use in slip rings. Contact materials are gold and/or silver and alloys therefrom for example. No contact materials are steel for example which can be used as a result of its spring properties as the core of a brush if it is coated with a contact material, or also nickel which is used in the galvanic layer structure of slip rings beneath a layer of contact material.

A further embodiment relates to a method for producing a slideway for the sliding contact with a brush. In this case, the brush has a first contact material on the surface.

The method comprises the following steps:

Coating of the slideway with a third contact material which has a lower abrasion than the brush in contact with said brush;

Coating of the slideway with a second contact material which in contact with the brush has a higher abrasion than the brush.

All previously described variants and embodiments may be combined with this method.

BRIEF DESCRIPTION OF THE DRAWINGS

In the following, the invention will be described by way of example, without limitation of the general inventive concept, on examples of embodiment and with reference to the drawings.

Figure 1:
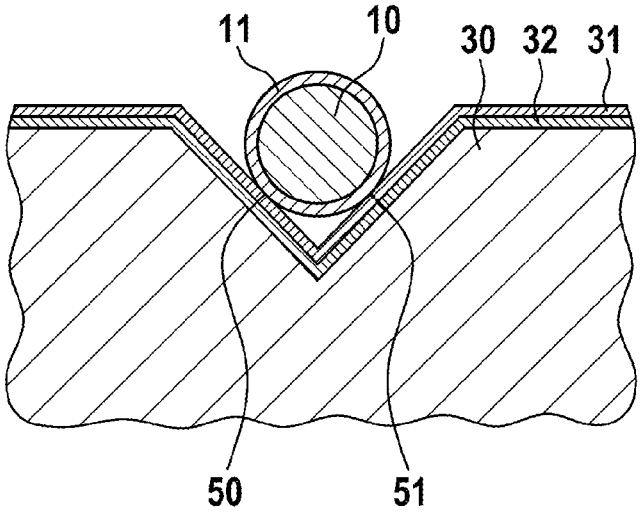
FIG. 1 shows a first embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a first embodiment. The brush 10 comprises a layer 11 made of a first contact material, which ma be a first gold alloy. Alternatively, the brush can also completely consist of said first contact material. It runs in a V-shaped groove of the slideway 30 and rests on the contact points 50, 51 on the slideway. The slideway 30 comprises a bottom layer 32 with a third contact material which may be a third gold alloy and an upper layer 31 with a second contact material, which may be a second gold alloy. The layers of the contact materials are shown in the drawings in a clearly enlarged manner in order to provide better illustration to the drawings. Actually, it is preferred to have the layer thicknesses are in the range of approximately 3 μm to 5 μm.

Figure 2:
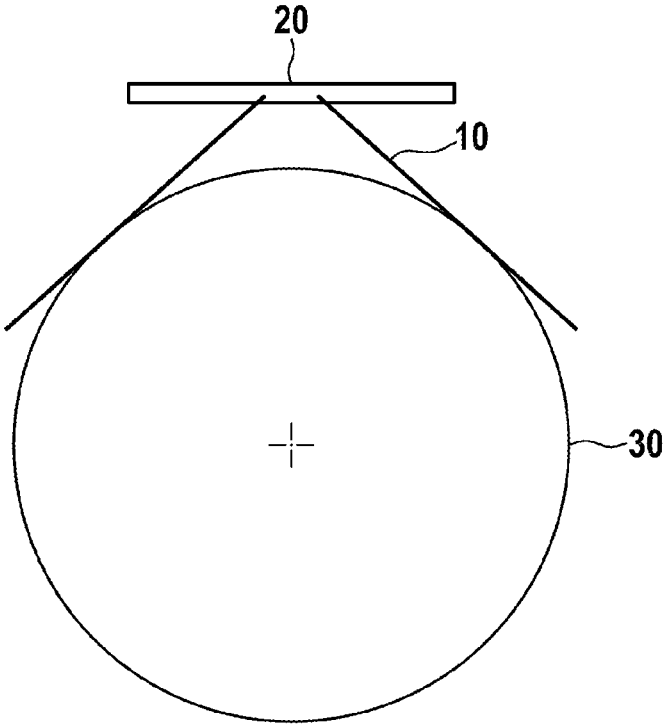
FIG. 2 shows a slip ring assembly of general form.

FIG. 2 shows a slip ring assembly of general form. At least one brush 10 runs on a slideway 30, which brush is held by a brush-holder device 20.

Figure 3A:
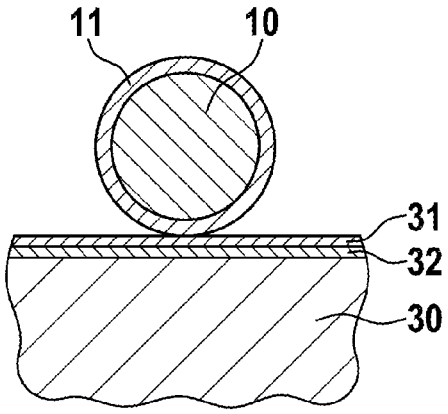
FIGS. 3A-3C show various steps of the abrasion.
Figure 3B:
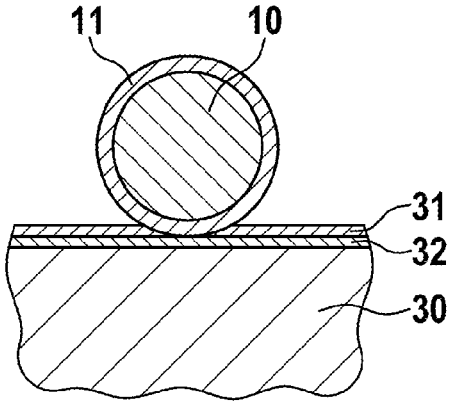
Figure 3C:
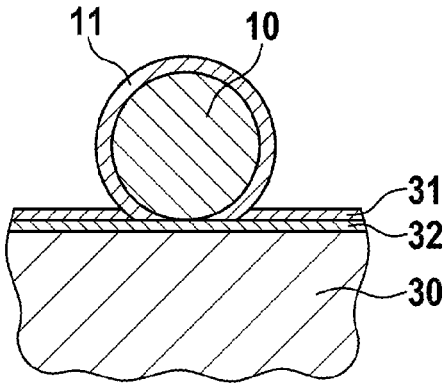

FIGS. 3A-3C show various stages of the abrasion. In this respect, FIG. 3A shows the new state with completely arranged and non-abraded layers made of contact materials 11, 31, 32. FIG. 3B shows a worn upper layer 31 with a second contact material of the slideway. In this case, the layer 11 with the first contact material of the brush is still without any wearing phenomena. Further use of the slip ring leads to wear and tear of this layer too, so that the state shown in FIG. 3C occurs. In the event that the brush has a core of a non-contact material such as steel for example, the wearing threshold is reached. If the brush should consist massively of the first contact material, its use can further be continued.

Figure 4:
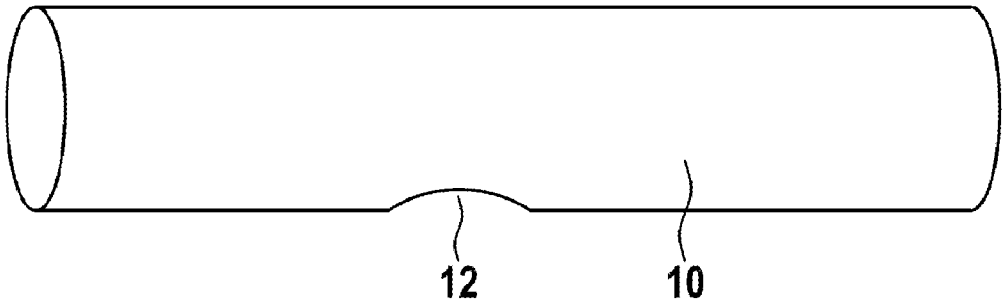
FIG. 4 shows a brush with visible wear and tear.

FIG. 4 shows a side view of a brush 10 with worn contact material. A material defect has occurred at position 12 by sliding on the slideway. It can be used for indicating wear and tear. As long as the brush is without defects in the material, the upper layer 31 with the second contact material of the slideway is obviously still worn off and a wearing threshold has not yet been reached. Only when material defects occur on the brush will it slide in the bottom layer 32 of the slideway. An exchange or a renewal of the slideway should now occur in this state.

It will be appreciated to those skilled in the art having the benefit of this disclosure that this invention is believed to provide contacting sliprings, sliding tracks and brushes thereof used for the transmission of electrical signals. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 Brush
11 Layer with first contact material
12 Material defect on the brush
20 Brush-holder support
30 Slideway
31 Upper layer with second contact material
32 Bottom layer with third contact material
40 Slideway support
50, 51 Contact points

The invention claimed is:

1. A slip ring assembly, comprising:

a brush with a first contact material coupled to a surface of the brush; and a slideway in contact with the brush, the comprising a base, second and third contact materials coupled to a surface of the base, where a layer of the third contact material is disposed between the base and a layer of the second contact material, wherein the assembly is configured such that:

when the brush is in sliding contact with the second contact material of the slideway, the abrasion of the first contact material of the brush is less than the abrasion of the second contact material of the slideway, and in the event that the layer of the second contact material of the slideway is worn through and the brush is in sliding contact with the layer of the third contact material of the slideway, the abrasion of the first contact material of the brush will be higher than the abrasion of the third contact material of the slideway and the slip ring assembly can continue to function.

2. A slip ring assembly according to claim 1, characterized in that the hardness of the second contact material is lower than the hardness of the first contact material.

3. A slip ring assembly according to claim 2, characterized in that the hardness of the third contact material is higher than the hardness of the first contact material.

4. A slip ring assembly according to claim 1, characterized in that the hardness of the third contact material is higher than the hardness of the first contact material.

5. A slip ring assembly according to claim 1, characterized in that the layer of the third contact material of the slideway has a smooth surface.

6. A slip ring assembly according to claim 1, characterized in that the layer of the third contact material of the slideway has a roughness height of less than 1 μm.

7. A method for producing a slideway for sliding contact with a brush having a base, a first contact material on a surface of the brush, the method comprising:

coating a surface of the base of the slideway with a layer of a third contact material that is configured to, in sliding contact with the brush, have a lower abrasion than the first contact material of the brush;

coating the layer of the third contact material with layer of a second contact material that is configured to, in sliding contact with the brush, have a higher abrasion than the first contact material of the brush, so that a slip ring assembly comprising the brush and the slideway can continue to function in the event that the layer of the second contact material is worn through.

8. A method according to claim 7, characterized in that the hardness of the second contact material is lower than the hardness of the first contact material.

9. A method according to claim 8, characterized in that the hardness of the third contact material is higher than the hardness of the first contact material.

10. A method according to claim 7, characterized in that the hardness of the third contact material is higher than the hardness of the first contact material.

11. A method according to claim 7, characterized in that the layer of the third contact material of the slideway has a smooth surface.

12. A method according to claim 7, characterized in that the layer of the third contact material of the slideway has a roughness height of less than 1 μm.

* * * * *